United States Patent [19]

Deeman

[11] Patent Number: 4,473,448

[45] Date of Patent: Sep. 25, 1984

[54] ELECTRODEPOSITION OF CHROMIUM

[75] Inventor: Neil Deeman, Stirchley, England

[73] Assignee: W. Canning Materials Limited, England

[21] Appl. No.: 345,399

[22] Filed: Feb. 3, 1982

[30] Foreign Application Priority Data

Feb. 9, 1981 [GB] United Kingdom ..... 8103886

[51] Int. Cl.[3] ..... C25D 3/04

[52] U.S. Cl. ..... 204/51; 204/43 R

[58] Field of Search ..... 204/51, 43 R

[56] References Cited

U.S. PATENT DOCUMENTS

| | | | |
|---|---|---|---|
| 2,088,615 | 8/1937 | Schlötter | 204/51 |
| 4,062,737 | 12/1977 | Barclay et al. | 204/51 |
| 4,157,945 | 6/1979 | Ward et al. | 204/51 |

FOREIGN PATENT DOCUMENTS

| | | | |
|---|---|---|---|
| 1488381 | 10/1977 | United Kingdom | 204/51 |

*Primary Examiner*—Donald L. Walton
*Assistant Examiner*—Gerard P. Rooney, Jr.
*Attorney, Agent, or Firm*—Darby & Darby

[57] ABSTRACT

Trivalent chromium is electrodeposited from an aqueous bath in which are dissolved very small proportions of compounds of classes (I) compounds containing

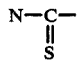

group, preferably a thiocyanate or a compound of formula X—CSNR where X is R, S or, $NR_2$ or is —$CSNR_2$ joined by —S— or —S—S— and R is H, alkyl, alkenyl, alkynyl or aromatic: (II) compounds of formula (X)—$SO_2$—(Y) in which X is (a) a saturated or unsaturated two or three carbon atom alpiphatic group terminating in a mercapto group or (b) the disulphide corresponding thereto, of formula Y—($SO_2$)—X—S—S—X($SO_2$)—Y or (c) single unsubstituted benzene ring; and Y is —ONa, —OH, —$NH_2$ or when X is a single unsubstituted benzene ring, a direct —NH— linkage or indirect —NH—CO-linkage to the ortho position thereof, (III) compounds of formula HOOC —$(CH_2)_n$—$S_m(CH_2)$COOH where n or m is 1 or 2; (IV) o-mercaptobenzoic acid and (V) sodium salts of sulphur, selenium and tellurium.

26 Claims, No Drawings

ELECTRODEPOSITION OF CHROMIUM

The invention relates to the electrodeposition of chromium from aqueous electrolytes containing trivalent chromium ions.

Conventionally chromium has been electrodeposited from solutions containing hexavalent chromium with a small quantity of sulphuric acid. However, hexavalent chromium can present serious environment and health hazards, the solution itself being highly toxic and corrosive. Also it has long been characterised as having poor throwing power, limited covering power and low electrical efficiency whilst being sensitive to current interruptions resulting in so called "white-washing" of the deposit.

To overcome these disadvantages, at least in part, chromium electroplating baths based on trivalent chromium complexes have been formulated. Such plating baths have excellent throwing power and are tolerant to current interruption. However, the colour of the plate obtainable is often darker than that obtained from hexavalent chromium baths, so that there has hitherto only been a limited commercial exploitation of such baths containing trivalent chromium complexes.

One prior proposal is to electrodeposit from a solution in which the $Cr^{+++}$ions are complexed with thiocyanate, using Cr:NCS molar ratios of between 1:1 and 1:6, preferably about 1:2, to optimise efficiency and colour and minimise undesired gas emission. Because the thiocyanate complex forms only slowly, it was essential to heat the chromium salt solution with the thiocyanate at 80° for 2 to 4 hours at a controlled pH to equilibrate it prior to use in electrodeposition.

In contrast to this, it has now been discovered that very low concentrations of thiocyanate can be utilised without prior equilibration and that moreover other usually sulphur-containing, and preferably organic compounds (not hitherto used in chromium electrodeposition) can now be used as additives at equivalently low levels to give effective and acceptable electrodeposits. The concentration of such compounds is, according to the invention, always lower than the 1:1 ratio previously described for the thiocyanate complexes, and is preferably one or more orders of magnitude lower, so that it appears that a different mechanism is involved from the bulk formation of thiocyanate complex throughout the whole solution. Possibly there is rapid, equilibrated, complex formation, decomposition and reformation in the immediate vicinity of the depositing layer of metal, so that the small amount of this compound has an effectively catalytic effect, but the Applicants do not intend to limit their invention by any hypothesis as to the mode of action.

While according to the invention the sulphur-containing compound is present in less than the 1:1 proportion, so that it cannot form a complex with all of the trivalent chromium present, it is possible although not necessary for other complexing agents of different type to be present. Uncomplexed trivalent chromium ion is green in colour, and is generally present in the practice of our invention.

In one aspect therefore the invention provides an electroplating solution containing trivalent chromium ions together with a dissolved compound of the classes I to V listed below, in a proportion less than equimolar in relation to the trivalent chromium ions.

The relative molar concentration of the trivalent chromium to the compound is always more than the 1:1 ratio mentioned in respect of thiocyanate complexes in the prior art and is usually more than 1:0.1, many compounds being effective at considerably higher chromium ratio of 1:0.01 or 1.0.001 or in some cases even more.

In practice the chromium ion concentration will usually lie within the range 0.01 to 1.0 molar. Correspondingly, the compounds will usually be present in amounts from 1 to 500 milligrams per liter, more especially 10 to 100 mg/l.

Preferably, the compound will be organic and sulphur-containing.

Class I compounds as defined herein consists of those compounds with an

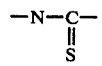

group within the molecule. Preferably, these are either a thiocyanate in salt or ester form or a compound which can be expressed by the formula:

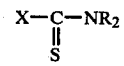

wherein X is either (a) —R, —S or —$NR_2$ or (b) represents another group of the formula

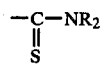

linked to the first by —S— or —S—S—; the R group being the same or different and chosen from hydrogen; straight or branch chain alkyl, alkenyl, or alkynyl groups, and mononuclear or binuclear carbocyclic aromatic groups, R being either unsubstituted or substituted by a carboxylic acid group or a salt or ester thereof.

The organic compounds should be water soluble. Usually therefore they will be of relatively low molecular weight (e.g. less than 300) so that R is preferably hydrogen or preferably at most possesses not more than six carbon atoms for example $C_1$ to $C_3$ alkyl. Specific compounds suitable for use in accordance with class I of the present invention include:

sodium thiocyanate $Na^+$ $(NCS)^-$ (a)
(thiocyanic acid has two tautomeric forms

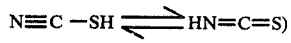

thiourea, $NH_2-C(=S)-NH_2$ (b)

N—monoallyl thiourea $NH_2-C(=S)-NHC_3H_5$ (c)

N—mono-p-tolyl thiourea, $NH_2-C(=S)-NH-C_6H_4-CH_3$ (d)

thioacetamide, $NH_2-C(=S)-CH_3$ (e)

-continued (n.b. also expressed as NH=C—CH3)

SH tetramethyl thiuram monosulphide, (f)

$(CH_3)_2N-\underset{\underset{S}{|}}{C}-S-\underset{\underset{S}{|}}{C}-N(CH_3)_2$ tetraethyl thiuram disulphide, (g)

$(C_2H_5)_2N-\underset{\underset{S}{\|}}{C}-S-S-\underset{\underset{S}{\|}}{C}-N(C_2H_5)_2$ sodium diethyldithiocarbamate (h)

$Na^+(-S-\underset{\underset{S}{\|}}{C}-N(C_2H_5)_2)^-$

The organic compounds described above can be used in combination with one another.

Class II of compounds according to the invention consists of compounds of formula (X)—$SO_2$—(Y) in which X is (a) a saturated or unsaturated two or three carbon atom aliphatic group terminating in a mercapto group or (b) the disulphide corresponding thereto, of formula Y—($SO_2$)—X—S—S—X($SO_2$)—Y or (c) a single unsubstituted benzene ring; and Y is —ONa, —OH, —$NH_2$ or when X is a single unsubstituted benzene ring, a direct —NH— linkage or indirect —NH—CO linkage to the ortho position thereof.

Specific compounds of utility in Class II are:

sodium allyl sulphonate $CH_2$=CH $CH_2SO_3Na$, sodium vinyl sulphonate $CH_2$=CH $SO_3Na$, mercaptopropane sulphonic acid HS—$CH_2CH_2CH_2SO_3H$, bis-(sodium sulphopropyl)disulphide $HO_3S-CH_2CH_2CH_2-S-S-CH_2CH_2CH-SO_3H$, benzene sulphonamide $C_6H_5SO_2NH_2$, thiamazole of formula

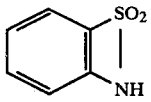

or saccharin of formula

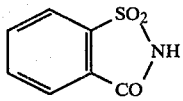

All of the above compounds possess a sulphonic or sulphonamide group attached to a simple short-chain mercapto-containing group or to a single unsubstituted benzene ring.

It seems possible that the practice of the invention depends on the formation of transient deposition-affecting species near the layer of deposition, and we have found that departure from the definition of Class II compounds e.g. by substitution of the benzene ring, is not advisable. Thus, certain naphthalene compounds (2,7-naphthalene disulphonic acid, the naphthalene trisulphonic acids) do not work effectively. Moreover, the alkyl-substituted toluene-4-sulphonamide or toluene-4-sulphonic acid are also not very effective. The same applies to the bis-benzene sulphonamides or the benzene-m-disulphonic acid. The more complex ring systems e.g. 5-sulphosalicylic acid, 3(benzothiazolyl-2 mercapto)-propyl sulphonic acid and 1-(β-hydroxyethyl) 2-imidazolidine thione also do not give as satisfactory results. Moreover, in relation to the alkyl compounds, the corresponding hydroxy-compound i.e. isethenic acid HO—$CH_2$—$CH_2$—$SO_3$—H is not of primary interest. If decomposition products are involved in the process of the invention it may be that an increase in complexity of the initial material gives undesirable reactions at the deposition layer.

Class III of preferred compounds consists of the compounds of formula HOOC—$(CH_2)_n$—$S_m$—$(CH_2)_n$—COOH where n or m is 1 or 2. Preferred examples are dithiodiglycollic acid and thiodiglycollic acid. Once again, departure from this category of compound is inadvisable. A higher member of the series, thiodipropionic acid of formula HOOC—$CH_2CH_2$—S—$CH_2CH_2COOH$ is less effective than the lower members.

Class IV of preferred compounds is similar to Class III, and consists in the compounds of formula:

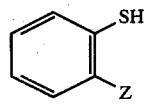

where Z is a water-solubility-conferring group e.g. —COOH, —OH or —$SO_3H$.

The aromatic ring linkage between for example the —COOH and the —SH groups appears to give an effective product.

All of the above organic compounds, of classes I to IV are inter-related in that they possess either one or more thiol groups, or groups electrochemically related thereto.

Class V of compounds is not organic but inorganic and consists of the sodium salts of acids of sulphur, selenium and tellurium from the list comprising metabisulphite, dithionite, sulphide, selenate, selenite, tellurate and tellurite.

A buffering agent may be present and may comprise boric acic or one or more borates. Alternatively, or additionally, one or more other buffering agents may be present, for example a carboxylic acid or a carboxylic acid salt such as citrate, tartrate, malate, formate or acetate.

To increase the conductivity of the electrolyte solution and hence reduce the power consumption required for chromium electrodeposition, conductivity salts may be added. These are desirable but not essential and so may vary in concentration from zero to saturation. Typical conductivity salts are salts of alkali or alkaline earth metals with strong acids for example chloride or sulphate of potassium or sodium. Ammonium ions may also be useful in increasing conductivity and also may provide some buffering action.

It is preferable that the solution be acidic since at a pH greater than 4.5 chromium may be precipitated from solution. Below pH 1.5 some loss in coverage may occur and the plating rate may decrease. The optimum pH range is from about 2.5 to about 4.0.

Wetting agents or surfactants are desirable, though not essential, since they may increase coverage and plating rates. Typical concentrations range from 0.1 to 10 grams per liter. The choice of wetting agent is not as critical as in hexavalent chromium baths since the solution of the present invention is not as highly oxidising. Indeed, those wetting agents frequently employed in nickel electroplating baths may be used in the solution of the present invention for example, sulphosuccinates such as sodium dihexylsulphosuccinate or alcohol sulphates such as sodium 2-ethylhexyl sulphate. Antifoaming agents may also be added.

A particular preferred form of the solution of the present invention comprises trivalent chromium ions, the water-soluble organic compound as described above, both borate and a buffer other than borate, a conductivity salt, and a wetting agent and be formulated in a hydrogen concentration to afford the appropriate pH less than 4.5.

The presence of incidental amounts of other organic or inorganic species is acceptable if they do not affect the plating to an undesirable extent. The solution cannot however tolerate a large amount of hexavalent chromium and it may be necessary to add a suitable reducing agent, for example a bisulphite, formaldehyde, glyoxal or more especially a sulphite e.g. as sodium sulphite, to convert hexavalent chromium to trivalent chromium. This treatment may be necessary particularly if the solution is to be used directly in contact with an inert anode since oxidation of trivalent chromium to hexavalent chromium can occur on electrolysis.

The bath may conveniently be made up by dissolving water-soluble salts of the required inorganic species, and salts or other suitable water-soluble forms of the organic species in sufficient water to afford the required concentration.

Preparation of the bath may be accomplished at room temperature though it is preferable to heat the solution to about 50° C. to increase the rate of dissolution of the solid species.

Another aspect of the present invention is an electroplating process in which a workpiece (preferably a metal workpiece) is immersed in a solution as described above and an electric current is passed through the solution from a compatible anode to the workpiece as a cathode whereby there is produced an electrodeposited chromium plate. Use of this process can give light coloured electrodeposits similar in appearance to those obtained from solutions containing hexavalent chromium values.

The operating temperature of the solution of the present invention is preferably from 10° to 90° C., e.g. 40°–60° C. 50° C. is considered optimum. Current densities between 1 and 100 amperes per square decimeter may be employed and 10 amperes per square decimeter may be considered as optimum. If the pH of the solution during operation varies outside the recommended range, control may be accomplished by addition of, for example, hydrochloric or sulphuric acids or of, for example, sodium, potassium or ammonium hydroxide.

During operation of the process it may be advantageous to separate the anode from the solution by a layer of inert material having a porous structure of the type that provides low permeability to the passage of liquids and low resistance to the passage of electric current. Alternatively an ion-selective membrane can be used. The insulating effect should not however be excessive. Such procedures are preferably if chloride or other halide ions are present in the solution.

It will be appreciated that the low organic content of the solution simplifies the effluent treatment after the plating process.

Another aspect of the invention is constituted by an article having on at least one surface thereof a chromium electrodeposit produced by the process described above.

A further aspect of the invention is a dry mix or concentrated solution of materials, suitable for dissolution in water, or suitable for dissolution in an existing electroplating bath to replenish desired constituents, so as to provide an electroplating solution as described above.

This may for example comprises a trivalent chromium salt, a conductivity salt, boric acid and the water-soluble organic compound in relative proportions such than when the dry mix is dissolved in water to a trivalent chromium ion content between 0.01 and 1.0M, the buffered pH lies between 1.5 and 4.5 and the organic compound is dissolved in the bath in a chromium ion:organic ratio of greater than 1:0.1. It can be used to make up the initial bath by dissolution in water using a wetting agent.

A replenishment additive preferably contains the chromium salt and the organic compound in higher proportions than those intended for bath operation to compensate for degradation in use. For example, an additive containing an organic compound:chromium ion ratio in a 1:65 weight ratio has been found generally useful as a replenishment additive, about 200 gm/Ampere-hr being utilised, preferably being made up as a concentrated solution prior to addition.

The invention will be further illustrated by the following examples.

EXAMPLE 1

The following species were dissolved in water and the resulting solution diluted to 1 liter with water.

Chrometan (containing 16.2% chromium): (Chrometan is the proprietary name for a commercially available mixture containing chromium sulphate and sodium sulphate): 10 g Boric acid: 60 g Potassium sulphate: 100 g Sodium 2-ethyl hexyl sulphate (40% solution): 1.0 ml The chromium content was therefore 1.62 g (32.2 millimoles). The pH of the solution was adjusted to 3.2 and the solution was heated to 50° C. A Hull cell test using a platinised titanium anode and a brass cathode was carried out on the solution for 3 minutes at a total current of 5 amperes. A very poor plate was produced i.e. a discoloration of the brass panel was seen and not a metallic coating. Addition of 100 milligrams per liter of thiourea (m.w. 76) to the solution (i.e. 1.32 mM) and repeating the Hull cell test gave a bright uniform chromium electrodeposit having an attractive light colour. The chromium:thiourea molar ratio was 1:0.0423.

EXAMPLE 2

A solution as given in example 1 was made up, but 50 milligrams per liter (0.67 mM) of thioacetamide m.w. 75 was added instead of thiourea. A Hull cell test produced a bright uniform chromium electrodeposit having an attractive light colour. The chromium:thioacetamide molar ratio was 1:0.0214.

EXAMPLE 3

A solution as given in example 1 was made up but 50 milligrams per liter (0.625 mM) of sodium thiocyanate of m.w. 80 were added instead of thiourea. A Hull cell test produced a bright uniform electrodeposit having an attractive light colour. The chromium:thiocyanate molar ratio was 1:0.02.

EXAMPLE 4

The following species were dissolved in water and the resulting solution diluted to 1 liter with water.

Chrometan: 100 g
Boric acid: 60 g
Malic acid: 10 g
Potassium sulphate: 100 g
Potassium chloride: 50 g
Sodium 2-ethyl hexyl sulphate (40% solution): 0.5 ml The chromium content was 16.2 g (312 mM).

The pH of the solution was adjusted to 3.5 and heated to 50° C. A Hull cell test gave a very poor plate i.e. some metallic coating at high current densities with green and black streaking at lower current densities. Addition of 20 milligrams per liter of mono N-p-tolyl thiourea of m.w. 166, i.e. 0.12 mM, and representing the Hull cell test produced a bright uniform chromium electrodeposit having an attractive light colour. The chromium:p-tolyl-thiourea molar ratio was 1:0.00038.

EXAMPLE 5

Example 4 was repeated using 20 milligrams of mono-N-allyl thiourea (m.w. 116, i.e. 0.172 mM) instead of tolyl derivative. Equivalent results were obtained. The chromium allyl thiourea molar ratio was 1:0.00055.

EXAMPLE 6

A solution as given in example 4 was made up but 50 milligrams per liter of sodium diethyl dithiocarbamate of m.w. 170, i.e. 0.294 mM, were added in place of the tolyl thiourea. A Hull cell test produced a bright uniform deposit having an attractive light colour. The chromium:dithiocarbamate molar ratio was 1:0.00094.

EXAMPLE 7

The following species were dissolved in water and the resulting solution diluted to 1 liter with water.

chromic chloride: 5 g (i.e. 1.64 g Cr, i.e. 31.5 mM)
Boric acid: 60 g
Potassium chloride: 100 g
Sodium sulphate: 150 g
Sodium dihexyl sulpho-succinate (60% solution): 0.5 ml The pH of the solution was adjusted to 2.5 and heated to 50° C. A Hull cell test produced a very poor plate i.e. a discolouration of the brass panel was seen and not a metallic coating. Addition of 10 milligrams per liter tetraethyl thiuram disulphide of m.w. 286 i.e. 0.035 mM, and repeating the Hull cell test produced a bright uniform chromium electrodeposit of attractive colour. The chromium:thiuram disulphide molar ratio was 1:0.00111.

EXAMPLE 8

A solution as given in example 6 was made up but 10 milligrams per liter of tetramethyl thiuram mono-sulphide of m.w. 208 i.e. 0.048 mM were added in place of the disulphide. A Hull cell test produced a bright uniform deposit having an attractive light colour. The chromium:thiuram sulphide molar ratio was 1:0.00152.

EXAMPLE 8

Example 1 was repeated except that instead of thiourea there was used, in seven different assessments:

(a) 2 g./1. (13.9 mM) sodium allyl sulphonate, giving a chromium:sodium allyl sulphonate molar ratio of 1:0.432.
(b) 5 g./1 (24.4 mM) of sodium saccharin, molar ratio 1:0.758.
(c) 10 mg./1. (0.0549 mM) dithiodiglycollic acid (1:0.0017)
(d) 50 mg./1 (0.325 mM) o-mercaptobenzoic acid (1:0.0101)
(e) 200 mg./1 (1.149 mM) sodium dithionite (1:0.0357)
(f) 500 mg./1 (2.646 mM) sodium selenate (1:0.0822)
(g) A mixture of 30 mg/1 (0.395 mM) of thiourea (1:0.0123)
(h) and 3 g./1. (14.6 mM of sodium saccharin (1:0.453)

In each case a significant improvement in plating was achieved, giving a bright uniform chromium electrodeposit with an attractive light colour.

I claim:

1. An electroplating solution containing trivalent chromium ions at least some of which are uncomplexed together with a dissolved compound selected from the group consisting of:

(i) compounds of the formula (X)—$SO_2$—(Y in which X is selected from the group consisting of (a) an aliphatic chain of less than three carbon atoms terminating in a mercapto group (b) a disulphide of the formula Y—$SO_2$—X—S—S—X—$SO_2$—y wherein X is as defined in (a) above and Y is as defined below, and (c) a single unsubstituted benzene ring, and Y is selected from the group consisting of ONa, —OH, —$NH_2$, a—NH—link to a benzene ring and a—NH—CO—link to a benzene ring;
(ii) compounds of the formula HOOC—$(CH_2)_n$—$S_m$—$(CH_2)_n$—COOH wherein n and m independently are integers not greater than 2;
(iii) compounds of the formula:

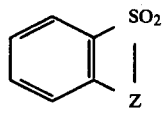

wherein Z is a group conferring water solubility, and (iv) a compound selected from the group consisting of sodium metabisulphite, sodium dithionite, sodium sulphide, sodium selenate, sodium selenite, sodium tellurate and sodium tellurite; said dissolved compound being present in a less than equimolar ratio in relation to the trivalent chromium ions thereby leaving at least part of the trivalent chromium ions uncomplexed by said compound.

2. A solution as claimed in claim 1 in which the relative molar concentration, of trivalent chromium to the said dissolved compound, is more than 1:0.1 respectively.

3. A solution as claimed in claim 2 in which the said ratio is more than 1:0.01 respectively.

4. A solution as claimed in claim 1, 2 or 3 which is from 0.01 to 1.0 molar in trivalent chromium.

5. A solution as claimed in claim 1, 2 or 3 containing from 1 to 500 mg/l of the said dissolved compound.

6. A solution as claimed in claim 1, 2 or 3 containing from 10 to 100 mg/l of the said dissolved compound.

7. A solution as claimed in claim 1, 2 or 3 in which the dissolved compound is a sulphur containing organic compound of the formula (X)—$SO_2$—(Y) in which X is selected from the group consisting of (a) saturated and unsaturated two and three-carbon atom aliphatic groups terminating in a mercapto group (b) disulphides of the formula (Y)—(SO2)—X—S—S—X—(SO2)—Y, wherein X is as defined in (a) above and Y is as defined below, and (c) a single unsubstituted benzene ring; and Y is selected from the group consisting of —ONa, —OH, and —$NH_2$ provided that when X is a single unsubstituted benzene ring, it includes direct—N-H—linkages and indirect—NH—CO—linkages to the ortho position of said ring.

8. A solution as claimed in claim 1, 2 or 3, in which the dissolved compound is selected from the group consisting of:

sodium allyl sulphonate $CH_2{=}CH{-}CH_2SO_3Na$,
sodium vinyl sulphonate $CH_2{=}CH{-}SO_3Na$,
mercaptopropane sulphonic acid $HS{-}CH_2CH_2CH_2SO_3H$,
bis-(sodium sulphopropyl) disulphide $HO_3S{-}OH_2CH_2CH_2{-}S{-}S{-}CH_2CH_2CH_2{-}SO_3H$,
benzene sulphonamide $C_6H_5SO_2NH_2$,
thiamazole of formula:

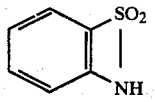

and saccharin of formula:

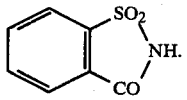

9. A solution as claimed in claim 1, 2 or 3 in which the dissolved compound is an organic compound of formula:

$$HOOC{-}(CH_2)_n{-}S_m{-}(CH_2)_n{-}COOH$$

where n or m is 1 or 2.

10. A solution as claimed in claim 1, 2 or 3 in which the dissolved compound is dithiodiglycollic acid or thiodiglycollic acid.

11. A solution as claimed in claim 1, 2 or 3 in which the dissolved compound is selected from the group consisting of ortho-mercapto benzoic acid, ortho-mercapto phenol and ortho-mercapto sulphonic acid.

12. A solution as claimed in claim 1, 2 or 3 in which the dissolved compound is selected from the group consisting of sodium salts of metabisulphite, dithionite, sulphide, selenate, selenite, tellurate and tellurite.

13. A solution as claimed in claim 1, 2 or 3 in which the dissolved compound is organic and has a molecular weight of less than 300.

14. A solution as claimed in claim 1, 2 or 3 of pH 1.5 to 4.5.

15. A solution as claimed in claim 1, 2 or 3 of pH 2.5 to 4.0.

16. A solution as claimed in any claim 1, 2 or 3 which contains a buffering agent.

17. A solution as claimed in claim 1, 2 or 3, which contains a buffering agent selected from the group consisting of boric acid, borates, carboxylic acids and carboxylic acid salts.

18. A solution as claimed in claim 1, 2 or 3 which includes a conductivity salt at a concentration up to saturation.

19. A solution as claimed in claim 1, 2 or 3 in which a wetting and and/or an antifoaming agent is present.

20. A solution as claimed in claim 1, 2 or 3 which includes a reducing agent.

21. An electroplating process in which (a) a workpiece is immersed in an electroplating solution in accordance with claim 1, 2 or 3, and (b) electric cuurent is passed through the solution from a compatible anode to the workpiece as a cathode to produce an electrodeposited chromium plate.

22. An electroplating process as claimed in claim 21 in which the current density over the workpiece is between 1 and 100 amperes per sq. decimeter.

23. A process as claimed in claim 21 in which the temperature of the bath is maintained between 10° and 90° C.

24. A process as claimed in claim 21 wherein the pH of the bath is maintained from about 2.5 to about 4.0.

25. A process as claimed in claim 21 in which the workpiece is metal.

26. An article having on at least one surface thereof a chromium electrodeposit produced by the process in which (a) a workpiece is immersed in the electroplating solution of claim 1, and (b) electric current is passed through the solution from a compatible anode to the workpiece as a cathode to produce an electrodeposited chromium plate.

* * * * *